United States Patent [19]

Brucker

[11] Patent Number: 4,886,993

[45] Date of Patent: Dec. 12, 1989

[54] SPARK GAP SWITCH WITH SPIRAL GAS FLOW

[75] Inventor: John P. Brucker, Espanola, N. Mex.

[73] Assignee: The United States of America as represented by the United States Department of Energy, Washington, D.C.

[21] Appl. No.: 172,096

[22] Filed: Mar. 23, 1988

[51] Int. Cl.[4] ..... H01J 17/26

[52] U.S. Cl. ..... 313/231.51; 313/231.01; 361/123

[58] Field of Search ..... 313/231.51, 231.31, 313/231.01, 570, 620–622, 231.11; 361/120, 121, 123

[56] References Cited

U.S. PATENT DOCUMENTS

| | | | |
|---|---|---|---|
| 3,551,737 | 12/1970 | Sheets | 313/231.61 |
| 4,280,098 | 7/1987 | Veraldi | 313/231.01 X |
| 4,563,608 | 1/1986 | Lawson et al. | 313/231.71 |

*Primary Examiner*—Donald J. Yusko
*Assistant Examiner*—Michael Horabik
*Attorney, Agent, or Firm*—Milton D. Wyrick; Paul D. Gaetjens; William R. Moser

[57] ABSTRACT

A spark gap switch having a contaminate removal system using an injected gas. An annular plate concentric with an electrode of the switch defines flow paths for the injected gas which form a strong spiral flow of the gas in the housing which is effective to remove contaminates from the switch surfaces. The gas along with the contaminates is exhausted from the housing through one of the ends of the switch.

14 Claims, 1 Drawing Sheet

SPARK GAP SWITCH WITH SPIRAL GAS FLOW

FIELD OF THE INVENTION

The present invention relates generally to the field of high voltage spark gap switches, and more specifically to the cleaning of contaminates from switch housings between switch firings. This invention is a result of a contract with the Department of Energy (Contract No. W-7405-ENG-36).

BACKGROUND OF THE INVENTION

Spark gap switches are used extensively in high voltage applications in both research and industry, such as in the output stages of high voltage particle accelerators. Such switches normally comprise a pair of electrodes separated by a gap inside a gas filled enclosure. The gas, a common feature of spark gap switches, serves to adjust the characteristics of the switch through its composition and pressure.

High voltage spark gap switches "close" when high voltage between the electrodes causes an arc to be established. This arc breakdown produces very high local temperatures and pressures, with concomitant chemical changes in the surrounding gas. Solid and liquid products of these changes precipitate out onto the interior surfaces of the switch and, if allowed to remain, will adversely affect the characteristics, and shorten the life of the switch through high voltage tracking on switch surfaces. Maintaining these switches in a clean condition over numerous firings is necessary because a typical switch costs approximately $6,500.00, and about two days downtime is required to manually clean or replace a switch.

In order to maintain proper switch performance and prolong the life of the switch over repeated switch operations, it is necessary to effectively clean the contaminating precipitates from the switch surfaces after each firing. Conventional attempts to accomplish this have involved purging the interior of the switch housing with a sweep gas introduced through one port, and withdrawn through a second port. This method is effective in removing contaminates in the switch gas, but is largely ineffective in removing solids or liquids that have precipitated onto switch surfaces.

A somewhat different approach to a contaminate removal system is disclosed in U.S. Pat. No. 4,563,608, to Lawson et al. Here, the switch gas also serves as the sweep gas. The gas is introduced through a nozzle in one of the electrodes, and is circulated through a venturi housing in the other electrode. The patent teaches that the flowing gas serves to control the firing stability of the switch, cool the switch, and carry away the reaction products. However, because of the relatively low gas velocity in the housing after entrainment of the low velocity gas, and the generally nonturbulent flow of this design, it does not appear that precipitated contaminants would be removed effectively from switch surfaces. Additionally, this switch is complex in design, requiring major alteration of the electrode containing the venturi housing and the housing end to which that electrode is mounted.

In U.S. Pat. No. 3,551,737 to Sheets there is disclosed a spark gap where a vortically flowing gas is used to stabilize arc discharge in a tube. The flow is established by four annular holes through which the gas flows into the enclosure. Although a vorticular flow of gas is established, it is not sufficiently turbulent to adequately remove contaminates on the surfaces of the electrodes and associated structures.

It is therefore an object of the present invention to provide a high voltage spark gap switch with improved surface cleaning capability, through use of a turbulent, spirally flowing gas.

It is a further object of the present invention to provide a high voltage spark gap switch having a longer lifetime, and requiring less maintenance than previous spark gap switches.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, apparatus for a high voltage spark gap switch having first and second axially aligned electrodes spaced apart in a sealed housing and a contaminate removal system using an injected gas may comprise an annular plate concentric with the first electrode and defining flow paths for the injected gas effective to form a spiral flow of the gas in the housing, and means for removing the gas from the housing.

In a further aspect of the present invention, and in accordance with its objects and purposes, a method of removing contaminates from spark gap switches having first and second axially aligned electrodes spaced apart in a sealed housing, using an injected gas, comprises the steps of forming a spiral flow of the gas in the housing and removing the gas from the housing.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE INVENTION

Figure 1:
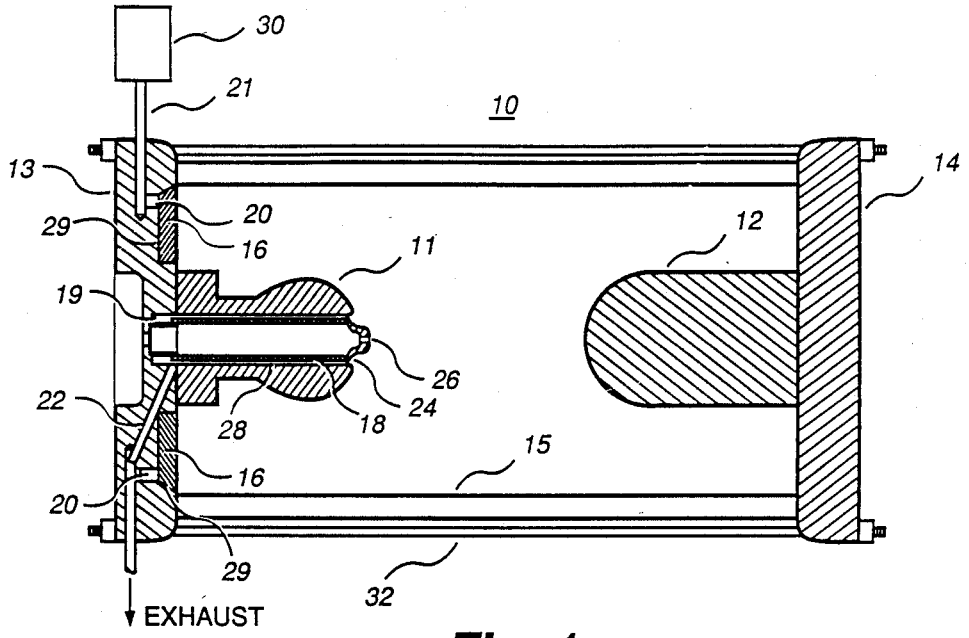
FIG. 1 is a simplified cross-sectional view of a high voltage spark gap according to the present invention.

One embodiment of the present invention is illustrated in FIG. 1, where a high voltage spark gap switch 10 is shown in a simplified cross-sectional view. Switch 10 primarily comprises housing 15, first end wall 13 and second end wall 14 connected together by dielectric tie rods 32. First electrode 11 is attached to first end wall 13 in axial alignment with, and spaced apart a predetermined distance from second electrode 12, which is attached to second end wall 14.

As shown, first electrode 11 is substantially hollow and comprises central aperture 26 through which a trigger pin (not shown) can be inserted. A trigger pin, when inserted into central aperture 26, substantially closes off central aperture 26, except for a gap of approximately 20–30 mils. Further, electrode 11 has exhaust apertures 24 circumferentially spaced around central aperture 26. Within the hollow portion of electrode 11, cylindrical tube 18 is inserted so that it substantially segregates annular space 28, the area below exhaust apertures 24, from the central hollow portion of electrode 11.

Cylindrical tube 18 directs exhaust gas, containing contaminants from the interior of housing 15 and flowing through exhaust apertures 24, through annular space 28, and into annular well 19 in first end wall 13. As seen, cylindrical tube 18 extends a short distance into annular well 19 to complete the sealing of annular space 28 from the central hollow portion of first electrode 11. The small amount of exhaust gas which may flow through the gap in the trigger pin (not shown) is of no significance.

First end wall 13 has exhaust conduit 22 connecting with annular well 19 and passing through first end wall 13 to a vent (not shown). Exhaust conduit 22 evacuates exhaust gas, with its entrained contaminates, from annular well 19.

First end wall 13 also contains annular plate 16 placed into annular channel 29 at the inner surface of first end wall 13. Annular manifold 20 is adjacent to, and opens into annular channel 29. High pressure gas inlet conduit 21 connects with annular manifold 20 to supply purging gas from gas source 30.

Figure 2:
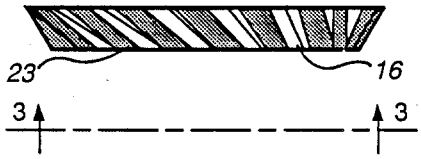
FIG. 2 is a side view of the annular conical plate showing the angled grooves which impart a spiral gas flow in the present invention.

Referring now to FIG. 2, there can be seen a side view of annular plate 16 with vee-shaped angled grooves 23 spaced apart equally around the periphery of annular plate 16. In one embodiment, annular plate 16 comprises forty-eight (48) angled grooves 23, equally spaced about its periphery, and having longitudinal axes inclined at an angle of 30° to the axis of annular plate 16. With annular plate 16 installed in annular channel 29, and high pressure gas supplied to annular manifold 20, angled grooves 23 allow jets of the gas to pass into housing 15, while imparting a strong spiral flow to the gas.

Although a 30° inclination of angled grooves 23 is effective to impart a strong spiral flow to the purging gas from annular manifold 20, the angle is not critical. It is believed that angled grooves 23 with inclinations of approximately 10° to 50° will perform satisfactorily, depending on the spiral velocity of the gas desired.

Figure 3:
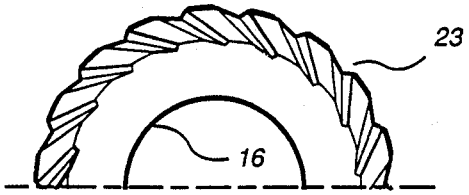
FIG. 3 is a partial bottom view of the annular conical plate providing another view of the angled grooves located about the periphery of the plate.

A partial bottom view of annular plate 16 is shown in FIG. 3 to better illustrate the position and effect of angled grooves 23. In one embodiment, angled grooves 23, having notch depths of approximately 0.04 inch, and included angles of approximately 90°, are effective to impart a strong, high-velocity spiral flow to the purging gas. Again, this notch depth and included angle are not critical, and departure from these dimensions may be acceptable depending on the spiral velocity required for a particular switch design.

To understand the operation of the invention it is best to refer back to FIG. 1. A purging gas from gas supply 30 is introduced through high pressure gas inlet conduit 21 into annular manifold 20. Because annular manifold 20 opens into annular channel 29, and because annular plate 16 seals all other routes for the gas out of annular channel 29, the high pressure gas is forced through angled grooves 23 (FIGS. 2 and 3) in annular plate 16, and enters the interior of housing 15 as turbulent, spiraling jets of high pressure gas. These turbulent jets of gas are extremely effective in removing contaminates from the switch gas, and from the switch surfaces in housing 15.

The gas, after having swept up the contaminating liquids and solids, is exhausted from housing 15 through exhaust apertures 24 in electrode 11. Exhaust apertures 24 are positioned circumferentially about the axis of electrode 11, and are directly over annular space 28. The gas then travels through annular space 28, between the inner surface of electrode 11 and the outer surface of cylindrical tube 18, into annular well 19 in base 13. From annular well 19 the gas and contaminants are transported out of base 13 through exhaust conduit 22 to an outside vent (not shown).

It should be understood that the purging gas could alternatively be exhausted through one or more ports in second end wall 14. This could be accomplished with a single port or a series of ports circularly arranged about second electrode 12. These ports could connect with an annular manifold which would be vented to the outside through an exhaust conduit. This configuration requires extra isolation, however, because second end wall 14 is the high-voltage end of switch 10.

The foregoing description of embodiments of the present invention has been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A spark gap switch having first and second axially aligned electrodes spaced apart in a sealed housing and a contaminate removal system using an injected gas, comprising:

an annular plate concentric with said first electrode and defining vee-shaped peripheral grooves for said injected gas effective to form a spiral flow of said gas in said housing; and means for removing said gas from said housing.

2. The apparatus as described in claim 1, wherein said annular plate comprises a plurality of said vee-shaped grooves circumferentially spaced apart around its periphery.

3. The apparatus as described in claim 2, wherein said vee-shaped grooves define an angle with the axis of said annular plate.

4. The apparatus as described in claim 3, wherein said angle is chosen from the group comprising angles of 10° to 50°.

5. The apparatus as described in claim 3, wherein said angle is 30°.

6. The apparatus as described in claim 1, wherein said means for removing said gas comprises a flow path in said first electrode.

7. The apparatus as described in claim 1, wherein said means for removing said gas comprises a flow path through one or more ports in an end wall of said housing.

8. A spark gap switch having first and second axially aligned electrodes spaced apart in a sealed housing and a contaminate removal system using an injected gas, comprising:

an annular plate concentric with said first electrode and defining angled vee-shaped peripheral flow paths for said injected gas effective to form a spiral flow of said gas in said housing; and wherein said first electrode defines a flow path for removal of said gas from said housing.

9. The apparatus as described in claim 8, wherein said angled vee-shaped peripheral flow paths defined by said annular plate comprise angled vee-shaped grooves circumferentially spaced apart around said annular plate.

10. The apparatus as described in claim 9, wherein said angled vee-shaped grooves define an angle of 30° with the longitudinal axis of said annular plate.

11. A method of removing contaminates from a spark gap switch having first and second axially aligned electrodes spaced apart in a sealed housing using an injected gas, comprising: forming a spiral flow of said gas in said housing by flowing said gas through a plurality of vee-shaped peripheral flow paths in an annular plate concentric with said first electrode; removing said gas from said housing.

12. The method as described in claim 11, wherein said plurality of flow paths define an angle of 30° with respect to the axis of said annular plate.

13. The method as described in claim 11, wherein said step of removing said gas comprises removing said gas through said first electrode.

14. The method as described in claim 11, wherein said step of removing said gas comprises removing said gas through one or more ports in an end wall of said housing.

* * * * *